US008177858B2

(12) United States Patent
Vanpachtenbeke et al.

(10) Patent No.: US 8,177,858 B2
(45) **Date of Patent: *May 15, 2012**

(54) FABRIC SOFTENING LAUNDRY DETERGENT

(75) Inventors: Tim Roger Michel Vanpachtenbeke, Puurs (BE); Francesco De Buzzaccarini, Breendonk (BE); Rajan Keshav Panandiker, West Chester, OH (US); Johan Depoortere, Merelbeke (BE); Karel Jozef Maria Depoot, Anzegem-Vichte (BE); Kerry Andrew Vetter, Cincinnati, OH (US)

(73) Assignee: The Proctor and Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/173,151

(22) Filed: Jun. 30, 2011

(65) Prior Publication Data

US 2011/0263475 A1 Oct. 27, 2011

Related U.S. Application Data

(63) Continuation of application No. 12/359,668, filed on Jan. 26, 2009, now Pat. No. 7,994,112.

(60) Provisional application No. 61/025,469, filed on Feb. 1, 2008.

(51) Int. Cl.

| | |
|---|---|
| ***B08B 3/04*** | (2006.01) |
| ***C11D 3/37*** | (2006.01) |
| ***C11D 1/04*** | (2006.01) |
| ***C11D 3/00*** | (2006.01) |

(52) U.S. Cl. ..... 8/137; 510/276; 510/329; 510/340; 510/343; 510/346; 510/351; 510/426; 510/437; 510/475; 510/481; 510/492; 510/504

(58) Field of Classification Search ..... 510/276, 510/329, 340, 343, 346, 351, 426, 437, 475, 510/481, 492, 504; 8/137
See application file for complete search history.

(56) References Cited

U.S. PATENT DOCUMENTS

| | | | |
|---|---|---|---|
| 6,949,498 | B2 | 9/2005 | Murphy et al. |
| 2010/0190679 | A1 | 7/2010 | Vanpachtenbeke et al. |

FOREIGN PATENT DOCUMENTS

| | | | |
|---|---|---|---|
| EP | 0 522 756 | A1 | 6/1992 |
| EP | 1 847 172 | A1 | 7/2006 |
| EP | 1 767 554 | A1 | 12/2006 |
| EP | 1847172 | * | 10/2007 |

OTHER PUBLICATIONS

International Search Report, 12 Pages, May 19, 2009.

* cited by examiner

*Primary Examiner* — Brian P Mruk
(74) *Attorney, Agent, or Firm* — Melissa G Krasovec; Leonard W Lewis

(57) ABSTRACT

Aqueous laundry detergent compositions containing surfactants and fatty acid, having a pH of from about 6 to about 11 and containing a polymer having a number average molecular weight of from about 700,000 to about 4,000,000 and comprising monomeric units including: nonionic monomers selected from acrylamide, N,N-dialkyl acrylamide, methacrylamide, N,N-dialkylmethacrylamide, hydroxyalkyl acrylate and vinyl pyrrolidone, vinyl acetate, vinyl alcohol, and mixtures thereof; cationic monomers selected from N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium chloride, acrylamidoalkylltrialkylammonium chloride, vinylamine, quaternized vinyl imidazole and diallyl dialkyl ammonium chloride, and mixtures thereof; and anionic monomers selected from acrylic acid, methacrylic acid, maleic acid, vinyl sulfonic acid, styrene sulfonic acid, acrylamidopropylmethane sulfonic acid (AMPS), salts thereof, and mixtures thereof; in a specified mole ratio.

19 Claims, No Drawings

FABRIC SOFTENING LAUNDRY DETERGENT

CROSS REFERENCE TO RELATED APPLICATIONS

This application is a Continuation of U.S. application Ser. No. 12/359,668, filed on Jan. 26, 2009, now U.S. Pat. No. 7,994,112, which in turn claims the benefit of U.S. Provisional Application No. 61/025,469 filed on Feb. 1, 2008.

FIELD OF THE INVENTION

The present invention relates to the field of domestic fabric laundering compositions that provide softness to fabrics through the wash and contain polymers.

BACKGROUND OF THE INVENTION

Numerous consumer products are available for the laundering of household/domestic fabrics. Similarly, many products exist that may be added during the rinse cycle of standard washing machine cycles or in domestic dryers that will deposit softening and/or other care actives onto the fabrics. This type of two or three step process has become very common for those consumers looking for both excellent cleaning and fabric softening. However, this two or three step process is more time-consuming and costly than a single wash-added product. More recently, due to consumer demands, manufacturers of laundry detergent products have sought to provide one product that provides both cleaning and fabric care benefits such as softness, through the wash.

It is important to realize, however, that these two goals (cleaning and softness) are traditionally diametrically opposed. Cleaning of fabrics typically results in the removal of dirt, allergens, stains, and other deposited materials. In contrast, providing a care benefit (such as a soft fabric feel) typically results from the deposition of beneficial care actives onto the fabrics. It is therefore difficult to simultaneously clean (remove) and soften (deposit) fabrics through the wash. In the past, it has been recognized in through the wash cleaning and care products that deposited care actives may entrap dirt or other materials onto the fabrics, resulting in a dingy appearance that is obviously undesirable to consumers. The deposited care actives may also themselves leave visible residue if they do not deposited evenly over the fabric surface. Similarly, it has been seen that the care actives are not deposited at all or are removed by the cleaning ingredients.

More recently, it has been recognized that low levels of cationic polymers, termed "cationic deposition aids" are capable of improving deposition onto fabrics of a range of desirable benefit agents, for fabric softening, perfumes, anti-wrinkle agents, hueing dyes, and the like. Such cationic deposition aids are described the art and fall generally into two classes: (1) "natural" types comprising a carbohydrate moiety, such as cationic hydroxyethylcellulose or cationic guar gum; and (2) "synthetic types" comprising cationic moieties but no carbohydrate. These "synthetic types" are exemplified by copolymers of polyacrylamide (PAM) and methacrylamidopropyltrimethylammonium chloride (MAPTAC). One difficulty with the "natural" types is their incompatibility with laundry detergent enzymes, especially enzymes having some degree of cellulase activity.

Furthermore, it has now been discovered that synthetic cationic deposition aids comprising cationic and uncharged (nonionic) monomers in the absence of anionic monomers at the pH of laundry washing tend to leave unsightly residues on laundered fabrics. These residues are easily visualized by the human eye when the laundered fabrics have a dark color. However, these findings are surprising in that prior disclosures of similar materials, such as U.S. Pat. No. 6,949,498, provide only indiscriminate lists of cationic polymers in liquid laundry detergents. Such disclosures only provide a measure of fabric softness benefits associated with the cationic polymers without any suggestion of visible residues, much less any disclosures of how to remedy such problems.

Accordingly, it would be highly desirable to identify improved laundry detergents comprising selected polymers capable of providing care benefits through the wash to fabrics while maintaining good cleaning and avoiding unsightly residues.

SUMMARY OF THE INVENTION

It has now been surprisingly and unexpectedly discovered that a select group of polymers, containing monomeric units derived from a combination of cationic monomers, nonionic monomers, and anionic monomers in a particular ratio, when incorporated into laundry detergent products, are capable of providing care benefits through the wash to fabrics while maintaining good cleaning and avoiding unsightly residues. Without intending to be limited by theory, it is believed that at a laundry wash pH, such as from about 6 to about 11, the present polymers are capable of depositing on fabrics in the laundering operation, but do so without leaving visible residue on laundry fabrics.

DETAILED DESCRIPTION OF THE INVENTION

All measurements referenced herein are at room temperature (about 21.1° C.) and at atmospheric pressure, unless otherwise indicated.

"Ampholytic" and "amphoteric" may be used interchangeably, and describe a polymer that comprises anionic monomeric units and cationic monomeric units. An ampholytic polymer may be: anionic at a pH that is higher than its isoelectric point; and cationic at a pH that is lower than its isoelectric point; wherein the isoelectric point is the pH at which the net charge on a polymer is zero.

"Net charge" as used herein refers to the sum of the electric charges of the monomeric units comprising a polymer. The net charge of ampholytic and other ionic polymers may be dependant upon conditions including, but not limited to the pH, temperature and soluble salt concentration of the carrier containing the polymers, such as the continuous phase of an aqueous dispersion.

"Monomer" as used herein refers to a molecule that may be capable of reacting to form polymers by chemical union with monomers such as itself, or other monomers or monomeric units. "Monomeric unit" as used herein refers to a chemically bound unit in a polymer that is derived from a monomer.

"Composition" as used herein may encompass the terms: dispersion, solution, melt (such as of a pure liquid substance), or fluid. "Dispersion" as used herein refers to a system of particles that may be evenly distributed in a medium, which is in turn referred to herein as the "continuous phase". The term "aqueous dispersion" as used herein may comprise a dispersion of particles (which may comprise the present polymers) distributed in a continuous phase comprising water.

"Viscosity" as used herein refers to the resistance of a fluid to flow due to a shearing force. The viscosity of a fluid may be dependent upon the conditions under which it is measured, such as fluid temperature.

"Comprising" as used herein means that various components, ingredients or steps can be conjointly employed in practicing the present invention. Accordingly, the term "comprising" encompasses the more restrictive terms "consisting essentially of" and "consisting of". The present compositions can comprise, consist essentially of, or consist of any of the required and optional elements disclosed herein.

Markush language as used herein encompasses combinations of the individual Markush group members, unless otherwise indicated.

All percentages, ratios and proportions used herein are by weight percent of the composition, unless otherwise specified. All average values are calculated "by weight" of the composition or components thereof, unless otherwise expressly indicated.

Mole percent (mol %) as used herein may mean either the percent of a monomeric unit in relation to all monomeric units of the polymer; or the mole fraction of reagents or reactants based upon other reagents or reactants.

All numerical ranges disclosed herein, are meant to encompass each individual number within the range and to encompass any combination of the disclosed upper and lower limits of the ranges.

The laundry detergent compositions according to the present invention contain water, a deposition polymer, fatty acid, and electrolyte and have a pH of from about 6 to about 11. Each of these components as well as optional ingredients for such compositions and methods of using such compositions are described in detail as follows.

Laundry Detergent Composition

The laundry detergent compositions of the present invention contain from about 5% to about 95%, alternatively from about 10% to about 95%, by weight of the composition, of water. In one embodiment, they may contain from about 40% to about 90%, by weight of the composition, of water, alternatively from about 50% to about 90%. The compositions have a pH of from about 6 to about 11, alternatively from about 7 to about 9.

Other types of water-miscible liquids, such alkanols, diols, other polyols, ethers, amines, and the like, may also be added to the detergent compositions of the present invention as co-solvents or stabilizers. However, these should generally be minimized for cost purposes.

The detergent compositions of the present invention may be in any convenient form. In one embodiment, the compositions are in the form of a liquid, a gel, a unit dose (pouched) product, or are part of a laundry kit.

Deposition Polymer

The laundry compositions of the present invention from about 0.02% to about 2%, by weight of the composition, of a deposition polymer having a number average molecular weight of from about 700,000 to about 4,000,000. In one embodiment, the molecular weight is from about 800,000 to about 3,000,000, alternatively from about 1,000,000 to about 2,500,000. In one embodiment, the laundry compositions of the present invention contain from about 0.05% to about 1%, by weight of the composition, of the deposition polymer, alternatively from about 0.1% to about 0.5%. In one embodiment, the deposition polymer has a charge density of less than 1 meq/gram.

The deposition polymer includes monomeric units, wherein the monomeric units are derived from monomers. The monomers include nonionic monomers, cationic monomers and anionic monomers wherein the overall mole ratio of the monomers, according to the following equation, $$\frac{\text{mole anionic monomer}}{(\text{mole anionic monomer} + \text{mole cationic monomer})}$$

is from 0.25 to 0.8. In one embodiment, the overall mole ratio is from about 0.28 to 0.8, alternatively is from about 0.3 to about 0.8, alternatively is from about 0.35 to about 0.7, alternatively is from 0.35 to 0.6.

Nonionic Monomer

The deposition polymer according to the present invention includes at least 50%, by mole, of monomeric units derived from nonionic monomers selected from acrylamide, N,N-dialkyl acrylamide, methacrylamide, N,N-dialkylmethacrylamide, hydroxyalkyl acrylate and vinyl pyrrolidone, vinyl acetate, vinyl alcohol, and mixtures thereof.

In one embodiment, the deposition polymer contains at least 70% of monomeric units derived from nonionic monomers. In one embodiment, the nonionic monomer is selected from acrylamide, vinyl pyrrolidone, and mixtures thereof, alternatively is acrylamide.

Cationic Monomer

The deposition polymer according to the present invention includes from about 3% to about 30%, by mole, of monomeric units derived from cationic monomers selected from N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium chloride, acrylamidoalkylltrialkylammonium chloride, vinylamine, quaternized vinyl imidazole and diallyl dialkyl ammonium chloride, and mixtures thereof.

In one embodiment, the deposition polymer contains from about 3% to about 10%, by mole, of monomeric units derived from cationic monomers. In one embodiment, the cationic monomers are selected from [(3-methylacrylamido)alkyl]trialkylammonium chloride, diallyldimethylammonium chloride, and mixtures thereof, alternatively is 3-methacrylamidopropyltrimethyl ammonium chloride.

Anionic Monomer

The deposition polymer according to the present invention includes from about 1% to about 20%, by mole, of monomeric units derived from anionic monomers selected from acrylic acid, acrylic acid, methacrylic acid, maleic acid, vinyl sulfonic acid, styrene sulfonic acid, acrylamidopropylmethane sulfonic acid (AMPS), salts thereof, and mixtures thereof.

In one embodiment, the deposition polymer includes from about 2.5% to about 6%, by mole, of monomeric units derived from anionic monomers. In one embodiment, the anionic monomer is selected from acrylic acid, methacrylic acid, and mixtures thereof, alternatively is acrylic acid.

In one embodiment, the polymer is formed from monomeric units derived from (on a mole basis) 90% acrylamide, 5% MAPTAC and 5% acrylic acid. In another embodiment, the polymer is formed from monomeric units derived from (on a mole basis) 92% acrylamide, 1.6% acrylic acid, 1.4% methacrylic acid, and 5% MAPTAC.

Counterion

The polymers of the present invention may also contain counterions. "Counterions", as used herein refers to any innocuous ions which do not adversely affect the functioning of the invention and serve only to balance the charge of otherwise non-neutral monomers or other actives. When not otherwise specified, and a monomer or other active material of the present compositions is anionic, suitable counterions include sodium, potassium, alkanolammonium and mixtures thereof. When not otherwise specified and a monomer or other active material of the present compositions is cationic, suitable counter-ions include nitrate, sulphate, chloride, carbonate, bicarbonate and mixtures thereof.

Surfactant System

The detergent compositions herein include from about 5% to about 60%, alternatively from about 5% to 40%, by weight of the composition, of a surfactant system containing from about 1% to about 25%, by weight of the surfactant system, of fatty acid, alternatively from about 3% to about 15%, alternatively from about 3% to about 10%. The laundry detergent compositions of the present invention may contain from about 75% to about 99%, by weight of the surfactant system, of a detersive surfactant.

Detersive surfactants utilized can be of the anionic, nonionic, zwitterionic, ampholytic or cationic type or can comprise compatible mixtures of these types. Detergent surfactants useful herein are described in U.S. Pat. No. 3,664,961, Norris, issued May 23, 1972; U.S. Pat. No. 3,919,678, Laughlin et al., issued Dec. 30, 1975; U.S. Pat. No. 4,222,905, Cockrell, issued Sep. 16, 1980; U.S. Pat. No. 4,285,841, Barrat et al., issued Aug. 25, 1981; U.S. Pat. No. 4,285,841, Barrat et al, issued Aug. 25, 1981; U.S. Pat. No. 4,284,532, Leikhim et al, issued Aug. 18, 19811; and in U.S. Pat. No. 4,239,659, Murphy, issued Dec. 16, 1980. Anionic and nonionic surfactants are preferred Fatty acids useful herein include those commonly commercially available. Such fatty acids may contain from about 8 to about 20 carbon atoms and can also contain from about 1 to about 10 ethylene oxide units in the hydrocarbon chain.

Suitable fatty acids are saturated and/or unsaturated and can be obtained from natural sources such a plant or animal esters (e.g., palm kernel oil, palm oil, coconut oil, babassu oil, safflower oil, tall oil, castor oil, tallow and fish oils, grease, and mixtures thereof), or synthetically prepared (e.g., via the oxidation of petroleum or by hydrogenation of carbon monoxide via the Fisher Tropsch process). Examples of suitable saturated fatty acids for use in the compositions of this invention include captic, lauric, myristic, palmitic, stearic, arachidic and behenic acid. Suitable unsaturated fatty acid species include: palmitoleic, oleic, linoleic, linolenic and ricinoleic acid. Examples of preferred fatty acids are saturated $C_{12}$ fatty acid, saturated $C_{12}$-$C_{14}$ fatty acids, and saturated or unsaturated $C_{12}$ to $C_{18}$ fatty acids, and mixtures thereof.

Electrolyte

The laundry detergent compositions of the present invention may contain at least 0.1%, by weight of the compositions, of an electrolyte.

Electrolytes useful herein include non-surface active electrolytes (as opposed to surfactants separately described herein). Examples of electrolytes useful herein include (i) polycarboxylic acid salts such as salts of citric acid, succinic acid, tartaric acids; salts of phosphonic acids or aminocarboxylic acids (which could also be chelating agents); (iii) salts of boric acids, and (iv) mixtures thereof.

Fatty Acid Crystal Modifier

The laundry detergent compositions of the present invention may contain a fatty acid crystal modifier.

The fatty acid crystal modifier is selected from sodium alkyl ethoxysulfate; quaternary ammonium surfactant; polyethyleneimine having a molecular weight of from about 300 to about 6000 and an average alkoxylation of from about 3 to about 30 moles of alkylene oxide per nitrogen; ethoxylated tetraethylene-pentaimines having an average ethoxylation of from 15 to 18; zwitterionic surfactants (such as alkyldimethylamine N-oxides, including dodecyldimethylamine N-oxide); chelating agents; zwitterionic amine-based soil release polymers; nonionic alkylpolyethoxylate; and mixtures thereof.

Sodium Alkyl Ethoxysulfate

The fatty acid crystal modifier may be selected from at least 5%, by weight of the composition, of sodium alkyl ethoxysulfate. In one embodiment, the composition contains from about 5% to about 25%, by weight of the composition, of sodium alkyl ethoxysulfate. Sodium alkyl ethoxysulfate is commonly used as a surfactant in laundry detergent compositions.

Quaternary Ammonium Surfactant

The fatty acid crystal modifier may be selected from about 0.1% to about 10%, by weight of the composition of a quaternary ammonium surfactant having the formula

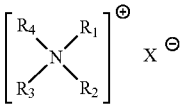

wherein $R_1$ and $R_2$ are individually selected from the group consisting of $C_1$-$C_4$ alkyl, $C_1$-$C_4$ hydroxy alkyl, benzyl, and —$(C_2H_4O)_xH$ where x has a value from about 2 to about 5; X is an anion; and (1) $R_3$ and $R_4$ are each a $C_8$-$C_{14}$ alkyl or (2) $R_3$ is a $C_8$-$C_{22}$ alkyl and $R_4$ is selected from the group consisting of $C_1$-$C_{10}$ alkyl, $C_1$-$C_{10}$ hydroxy alkyl, benzyl, and —$(C_2H_4O)_xH$ where x has a value from about 2 to about 5.

Zwitterionic Surfactants

The fatty acid crystal modifier may be selected from about 0.1% to about 10%, by weight of the composition, of a zwitterionic surfactant. Zwitterionic surfactants useful herein include those commonly known in the art such as alkyl amine oxides.

Chelating Agents

The fatty acid crystal modifier may be selected from about 0.05% to about 3%, by weight of the composition, alternatively from about 0.1% to about 1% of a chelating agent. Chelating agents useful herein include diethylene triamine penta acetate (DTPA).

Zwitterionic Amine-Based Soil-Release Polymers

The fatty acid crystal modifier may be selected from about 0.1% or more, by weight of the composition, of a zwitterionic amine-based soil-release polymer.

Fabric Care Benefit Agents

The laundry detergent compositions useful herein may include a fabric care benefit agent. As used herein, "fabric care benefit agents" refers to detergent ingredients which are water dispersible or water insoluble and can provide fabric care benefits such as fabric softening, color protection, pill/fuzz reduction, anti-abrasion, anti-wrinkle, perfume longevity and the like, to garments and fabrics, particularly on cotton garments and fabrics.

These fabric care benefit agents typically have the solubility in distilled water of less than 100 g/L, preferably less than 10 g/L at 25° C. It is believed that if the solubility of the fabric care benefit agent is more than 10 g/L, it will remain soluble in the wash liquor and consequently will not deposit onto the fabrics.

Examples of water insoluble fabric care benefit agents useful herein include dispersible polyolefins, polymer latexes, organosilicones, perfume or other active microcapsules, and mixtures thereof. The fabric care benefit agents can be in the form of emulsions, latexes, dispersions, suspensions, micelles and the like, and preferably in the form of microemulsions, swollen micelles or latexes. As such, they can have a wide range of particle sizes from about 1 nm to 100 um and preferably from about 5 nm to 10 um. The particle size of the microemulsions can be determined by conventional methods, such as using a Leeds & Northrup Microtrac UPA particle sizer.

Emulsifiers, dispersing agents and suspension agents may be used. The weight ratio of emulsifiers, dispersing agents or suspension agents to the fabric care benefit agents is about 1:100 to about 1:2. Preferably, the weight ratio ranges from about 1:50 to 1:5. Any surfactants suitable for making polymer emulsions or emulsion polymerizations of polymer latexes can be used to make the water insoluble fabric care benefit agents of the present invention. Suitable surfactants include anionic, cationic, and nonionic surfactants or mixtures thereof. Nonionic and anionic surfactants are preferred.

Typically, the emulsification of the care agent is achieved in situ in the liquid detergent. In such case, the benefit agent is slowly added to the liquid detergent with vigorous mixing.

Organosilicones

Suitable organosilicones, include, but not limited to (a) non-functionalized silicones such as polydimethylsiloxane (PDMS); and (b) functionalized silicones such as silicones with one or more functional groups selected from the group consisting of amino, amido, alkoxy, alkyl, phenyl, polyether, acrylate, siliconehydride, mercaptoproyl, carboxylate, sulfate phosphate, quaternized nitrogen, and combinations thereof.

In typical embodiments, the organosilicones suitable for use herein have a viscosity ranging from about 10 to about 700,000 CSt (centistokes) at 20° C. In other embodiments, the suitable organosilicones have a viscosity from about 10 to about 100,000 CSt.

(a) Polydimethylsiloxanes (PDMS) have been described in Cosmetics and Toiletries. They can be linear, branched, cyclic, grafted or cross-linked or cyclic structures. In some embodiments, the detergent compositions comprise PDMS having a viscosity of from about 100 to about 700,000 CSt at 20° C.

(b) Exemplary functionalized silicones include but are not limited to aminosilicones, amidosilicones, silicone polyethers, alkylsilicones, phenyl silicones and quaternary silicones.

The functionalized silicones suitable for use in the present invention have the following general formula:

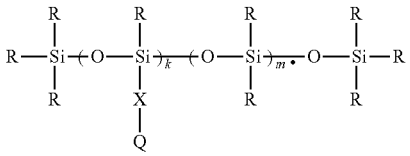

wherein m is from 4 to 50,000, preferably from 10 to 20,000;

k is from 1 to 25,000, preferably from 3 to 12,000;

each R is H or $C_1$-$C_8$ alkyl or aryl group, preferably $C_1$-$C_4$ alkyl, and more preferably a methyl group;

X is a linking group having the formula:

i) $—(CH_2)_p—$ wherein p is from 2 to 6, preferably 2 to 3;

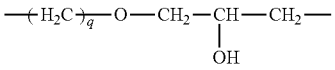

wherein q is from 0 to 4, preferably 1 to 2;

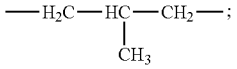

Q has the formula:

i) $—NH_2$, $—NH—(CH_2)_r—NH_2$, wherein r is from 1 to 4, preferably 2 to 3; or ii) $—(O—CHR_2—CH_2)_s—Z$, wherein s is from 1 to 100, preferably 3 to 30;

wherein $R_2$ is H or $C_1$-$C_3$ alkyl, preferably H or $CH_3$; and Z is selected from the group consisting of $—OR_3$, $—OC(O)R_3$, $—CO—R_4—COOH$, $—SO_3$, $—PO(OH)_2$, and mixtures thereof;

further wherein $R_3$ is H, $C_1$-$C_{26}$ alkyl or substituted alkyl, $C_6$-$C_{26}$ aryl or substituted aryl, $C_7$-$C_{26}$ alkylaryl or substituted alkylaryl groups, preferably $R_3$ is H, methyl, ethyl propyl or benzyl groups; $R_4$ is $—CH_2—$ or $—CH_2CH_2—$ groups; and

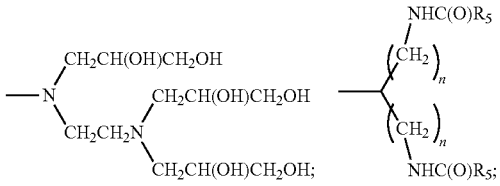

wherein n is from 1 to 4, preferably 2 to 3; and $R_5$ is C1-C4 alkyl, preferably methyl.

Another class of organosilicone useful herein is modified polyalkylene oxide polysiloxanes of the general formula:

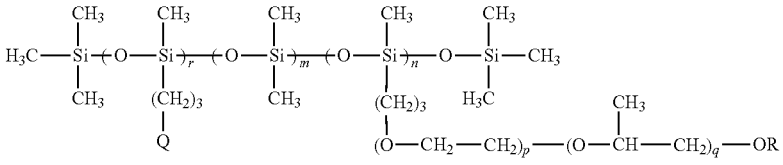

wherein Q is $NH_2$ or $—NHCH_2CH_2NH_2$; R is H or $C_1$-$C_6$ alkyl; r is from 0 to 1000; m is from 4 to 40,000; n is from 3 to 35,000; and p and q are integers independently selected from 2 to 30.

When r=0, nonlimiting examples of such polysiloxanes with polyalkylene oxide are Silwet® L-7622, Silwet® L-7602, Silwet® L-7604, Silwet® L-7500, Magnasoft® TLC, available from GE Silicones of Wilton, Conn.; Ultrasil® SW-12 and Ultrasil® DW-18 silicones, available from Noveon Inc., of Cleveland Ohio; and DC-5097, FF-400® available from Dow Corning® of Midland, Mich. Additional examples are KF-352®, KF-6015®, and KF-945®, all available from Shin Etsu Silicones of Tokyo, Japan.

When r=1 to 1000, nonlimiting examples of this class of organosilicones are Ultrasil® A21 and Ultrasil® A-23, both available from Noveon, Inc. of Cleveland, Ohio; BY16-876® from Dow Corning Toray Ltd., Japan; and X22-3939A® from Shin Etsu Corporation, Tokyo Japan.

A third class of organosilicones useful herein is modified polyalkylene oxide polysiloxanes of the general formula:

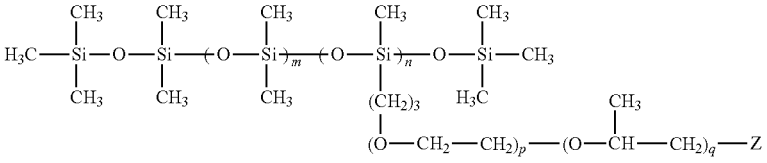

wherein m is from 4 to 40,000; n is from 3 to 35,000; and p and q are integers independently selected from 2 to 30; Z is selected from

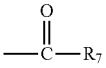

wherein $R_7$ is C1-C24 alkyl group;

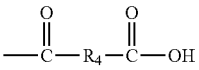

wherein $R_4$ is $CH_2$ or $CH_2CH_2$;

iii. $—SO_3$

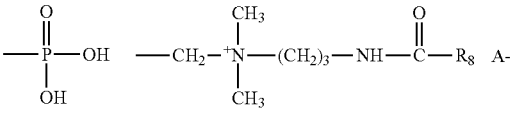

wherein $R_8$ is C1-C22 alkyl and A- is an appropriate anion, preferably $Cl^-$;

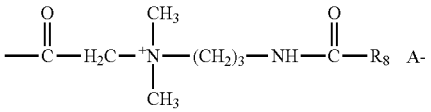

wherein $R_8$ is C1-C22 alkyl and A- is an appropriate anion, preferably $Cl^-$.

Another class of silicones is cationic silicones. These are typically produced by reacting a diamine with an epoxide. They are described in WO 02/18528 and WO 04/041983 (both assigned to P&G), WO 04/056908 (assigned to Wacker Chemie) and U.S. Pat. No. 5,981,681 and U.S. Pat. No. 5,807,956 (assigned to OSi Specialties). These are commercially available under the trade names Magnasoft® Prime, Magnasoft® HSSD, Silsoft® A-858 (all from GE Silicones) and Wacker SLM21200®.

One embodiment of the composition of the present invention contains organosilicone emulsions, which comprise organosilicones dispersed in a suitable carrier (typically water) in the presence of an emulsifier (typically an anionic surfactant).

In another embodiment, the organosilicones are in the form of microemulsions. The organosilicone microemulsions may have an average particle size in the range from about 1 nm to about 150 nm, or from about 10 nm to about 100 nm, or from about 20 nm to about 50 nm Microemulsions are more stable than conventional macroemulsions (average particle size about 1-20 microns) and when incorporated into a product, the resulting product has a preferred clear appearance. More importantly, when the composition is used in a typical aqueous wash environment, the emulsifiers in the composition become diluted such that the microemulsions can no longer be maintained and the organosilicones coalesce to form significantly larger droplets which have an average particle size of greater than about 1 micron. Since the selected organosilicones are water insoluble or have limited solubility in water, they will crash out of the wash liquor, resulting in more efficient deposition onto the fabrics and enhanced fabric care benefits. In a typical immersive wash environment, the composition is mixed with an excess of water to form a wash liquor, which typically has a weight ratio of water:composition ranging from 10:1 to 400:1.

A typical embodiment of the composition comprising from about 0.01% to about 10%, by weight of composition of the organosilicones and an effective amount of an emulsifier in a carrier. The "effective amount" of emulsifier is the amount sufficient to produce an organosilicone microemulsion in the carrier, preferably water. In some embodiments, the amount of emulsifiers ranges from about 5 to about 75 parts, or from about 25 to about 60 parts per 100 weight parts organosilicone.

The microemulsion typically comprises from about 10 to about 70%, or from about 25 to about 60%, by weight of the microemulsion of the dispersed organosilicones; from about 0.1 to about 30%, or from about 1 to about 20%, by weight of the microemulsion of anionic surfactant; optionally, from about 0 to about 3%, or from about 0.1 to about 20%, by weight of the microemulsion of nonionic surfactant; and the balance being water, and optionally other carriers. Selected organosilicone polymers (all those disclosed herein above, excluding PDMS and cationic silicones) are suitable for forming microemulsions; these organosilicones are sometimes referred to as the "self emulsifying silicones". Emulsifiers, particularly anionic surfactants, may be added to aid the formation of organosilicone microemulsions in the composition. Optionally, nonionic surfactants useful as laundry adjuncts to provide detersive benefits can also aid the formation and stability of the microemulsions. In a typical embodiment, the amount of emulsifiers is from about 0.05% to about 15% by weight of the composition.

Nonlimiting examples of anionic surfactants include the following: alkyl sulfonates, such as $C_{11}$-$C_{18}$ alkyl benzene sulfonates (LAS) or $C_{10}$-$C_{20}$ branched-chain and random alkyl sulfates (AS); $C_{10}$-$C_{18}$ alkyl ethoxy sulfates ($AE_xS$) wherein x is from 1-30; mid-chain branched alkyl sulfates (U.S. Pat. No. 6,020,303 and U.S. Pat. No. 6,060,443) or mid-chain branched alkyl alkoxy sulfates (U.S. Pat. No. 6,008,181 and U.S. Pat. No. 6,020,303); $C_{10}$-$C_{18}$ alkyl alkoxy carboxylates comprising 1-5 ethoxy units; modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; $C_{12}$-$C_{20}$ methyl ester sulfonate (MES); $C_{10}$-$C_{18}$ alpha-olefin sulfonate (AOS); and $C_6$-$C_{20}$ sulfosuccinates.

Dispersible Polyolefins

All dispersible polyolefins that provide fabric care benefits can be used as a fabric care benefit agents in the compositions of the present invention. The polyolefins can be in the form of waxes, emulsions, dispersions or suspensions. Examples of polyolefins useful herein are discussed below.

The polyolefin may be a polyethylene, polypropylene, or a mixture thereof. The polyolefin may be at least partially modified to contain various functional groups, such as carboxyl, alkylamide, sulfonic acid or amide groups. In one embodiment, the polyolefin is at least partially carboxyl modified or, in other words, oxidized.

For ease of formulation, the dispersible polyolefin may be introduced as a suspension or an emulsion of polyolefin dispersed in an aqueous medium by use of an emulsifying agent. When an emulsion is employed, the emulsifier may be any suitable emulsification agent including anionic, cationic, or nonionic surfactants, or mixtures thereof. Almost any suitable surfactant may be employed as the emulsifier of the present invention. The dispersible polyolefin is dispersed by use of an emulsifier or suspending agent in a ratio 1:100 to about 1:2. Preferably, the ratio ranges from about 1:50 to 1:5.

The polyolefin suspension or emulsion may comprise from about 1% to about 60%, alternatively from about 10% to about 55%, and still alternatively from about 20 to about 50% by weight of polyolefin.

The polyolefin may have a wax dropping point (see ASTM D3954-94, volume 15.04 "Standard Test Method for Dropping Point of Waxes", the method incorporated herein by reference) from about 20 to 170° C. and more preferably from about 50 to 140° C. Suitable polyethylene waxes are available commercially from suppliers including but not limited to Honeywell (A-C polyethylene), Clariant (Velustrol emulsion), and BASF (LUWAX).

Polymer Latexes

Polymer latex is typically made by an emulsion polymerization process which includes one or more monomers, one or more emulsifiers, an initiator, and other components familiar to those of ordinary skill in the art. All polymer latexes that provide fabric care benefits can be used as water insoluble fabric care benefit agents of the present invention. Non-limiting examples of suitable polymer latexes include those disclosed in WO 02/018451 published in the name of Rhodia Chimie.

Polymer latexes suitable for use herein as fabric care benefit agents include those having a glass transition temperature of from about −120° C. to about 120° C. and preferably from about −80° C. to about 60° C. Suitable emulsifiers include anionic, cationic, nonionic and amphoteric surfactants. Suitable initiators include all initiators that are suitable for emulsion polymerization of polymer latexes. The particle size of the polymer latexes can be from about 1 nm to about 10 μm and is preferably from about 10 nm to about 1 μm.

Microencapsulated Actives

The laundry compositions herein may contain microcapsules or microencapsulates containing one or more fabric care active materials. The terms "microcapsules" and "microencapsulates" are used interchangeably herein.

Microcapsules useful herein include urea/formaldehyde microcapsules, melamine/formaldehyde microcapsules, more generally aminoplast or polyamide microcapsules, and other types of core-shell microcapsules or microencapsulates having median particle sizes ranging from below 1 micron to 100 micron or higher can be used in the present compositions, suitably at levels of from 0.01% to 5% of the composition by weight. Smaller particle sizes, e.g., 10 microns or below (median) are preferred for incorporation into nonviscous liquid formulations, whereas in more viscous or thickened formulations, larger particle sizes can be employed and may offer desirable visual attributes. Such microcapsules can be colored or uncolored, e.g., by use of dyes and/or pigments, and further, can contain any useful compatible detergent adjunct including perfumes, anti-fungals, odor control agents, antistatic agents, fluorescent whitening agents, antimicrobial actives, emollients, UV protection agents, flame retardants, brighteners, enzymes and the like, enclosed in the core of the microencapsulate. Such materials are most commonly derived from technology and processes long ago established for making carbonless copy paper, and are available from a range of commercial suppliers such as Ciba, Givaudan/Quest BASF, IFF, Cognis, Appleton Papers, Chemitech and others. See for example WO-200274430 A1 (Quest International); US-20070202063 A1 (Appleton Papers); DE-10000223 A1 (BASF); WO2003002699 A1 (Colgate); WO03054125 (Henkel); US-2004138093 A1 or US-2004142828 A1 or EP 1533415 A1 or US20060287205 A1 or US20070004610 A1 (IFF); EP 1640063 A1 (Cognis); WO-2006056357 A1 (Innovacel); WO-2007063001 A1 (Ciba).

A perfume microcapsule contains an encapsulated perfume composition to provide a latent source of perfume. The perfume composition that is encapsulated may be comprised of 100% perfume, which encompasses individual perfume ingredients or perfume accords; optionally, the perfume composition may include non-volatile materials such as diluents. The diluent may be present from 0% to 50% of the perfume formulation. Exemplary diluents include isopropyl myristate, polyethylene glycol, propanediol, and combinations thereof.

Optional Fabric Adjuncts

The detergent compositions of the present invention can also include any number of additional optional ingredients. These include conventional laundry detergent composition components such as detersive builders, enzymes, enzyme stabilizers (such as propylene glycol, boric acid and/or borax), suds suppressors, soil suspending agents, soil release agents, other fabric care benefit agents, pH adjusting agents, smectite clays, solvents, hydrotropes and phase stabilizers, structuring agents, dye transfer inhibiting agents, optical brighteners, perfumes and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from about 5% to about 50%, alternatively from about 30% to about 40%, by weight of the composition. A few of the optional ingredients which can be used are described in greater detail as follows:

Pearlescent Agent

The laundry detergent compositions of the present invention may comprise from about 0.02% to about 0.5%, by weight of the composition, of a pearlescent agent. Examples of pearlescent agents useful herein include mica, metal oxide coated mica, bismuth oxy chloride coated mica, bismuth oxychloride, glass, metal oxide coated glass, ethylene glycol distearate, fish scales, and mixtures thereof. In one embodiment, the pearlescent agent has an average particle size of from 0.1 to 50 microns and has a platelet or spherical geometry.

Methods of Use

The compositions herein are contemplated for using in traditional machine-washing or hand-washing methods. The compositions may also be used on a commercial scale for laundering commercial quantities of fabrics or textiles. Use of the laundry compositions herein to launder or pre-treat fabrics is contemplated herein. Such use to impart an improved fabric feel and/or cleaning benefit to fabrics is further contemplated herein.

Encapsulated Composition

The compositions of the present invention may be encapsulated within a water soluble film. The water-soluble film may be made from polyvinyl alcohol or other suitable variations, carboxy methyl cellulose, cellulose derivatives, starch, modified starch, sugars, PEG, waxes, or combinations thereof.

In another embodiment the water-soluble may include other adjuncts such as co-polymer of vinyl alcohol and a carboxylic acid. U.S. Pat. No. 7,022,656 B2 (Monosol) describes such film compositions and their advantages. One benefit of these copolymers is the improvement of the shelf-life of the pouched detergents thanks to the better compatibility with the detergents. Another advantage of such films is their better cold water (less than 10° C.) solubility. Where present the level of the co-polymer in the film material, is at least 60% by weight of the film. The polymer can have any weight average molecular weight, preferably from 1000 daltons to 1,000,000 daltons, more preferably from 10,000 daltons to 300,000 daltons, even more preferably from 15,000 daltons to 200,000 daltons, most preferably from 20,000 daltons to 150,000 daltons. Preferably, the co-polymer present in the film is from 60% to 98% hydrolysed, more preferably 80% to 95% hydrolysed, to improve the dissolution of the material. In a highly preferred execution, the co-polymer comprises from 0.1 mol % to 30 mol %, preferably from 1 mol % to 6 mol %, of said carboxylic acid.

The water-soluble film of the present invention may further comprise additional co-monomers. Suitable additional co-monomers include sulphonates and ethoxylates. An example of preferred sulphonic acid is 2-acrylamido-2-methyl-1-propane sulphonic acid (AMPS). A suitable water-soluble film for use in the context of the present invention is commercially available under tradename M8630™ from Mono-Sol of Indiana, US. The water-soluble film herein may also comprise ingredients other than the polymer or polymer material. For example, it may be beneficial to add plasticisers, for example glycerol, ethylene glycol, diethyleneglycol, propanediol, 2-methyl-1,3-propane diol, sorbitol and mixtures thereof, additional water, disintegrating aids, fillers, anti-foaming agents, emulsifying/dispersing agents, and/or antiblocking agents. It may be useful that the pouch or water-soluble film itself comprises a detergent additive to be delivered to the wash water, for example organic polymeric soil release agents, dispersants, dye transfer inhibitors. Optionally the surface of the film of the pouch may be dusted with fine powder to reduce the coefficient of friction. Sodium aluminosilicate, silica, talc and amylose are examples of suitable fine powders.

The encapsulated pouches of the present invention can be made using any conventionally known techniques. In one embodiment, the pouches are made using horizontal form filling thermoforming techniques.

EXAMPLES

Example I

Residue Testing

The presence of residues is assessed in a full scale washing machine test using Miele Novotronic W527.

Residue Protocol:

1. The fabric used to assess residues on fabrics is a black velvet (Material source: Denholme Velvets, Halifax Road, Denholme, Bradford, West Yorkshire, England BD13 4EZ-tel. (01274) 832 646, with the specifications 150 cm C.R. Cotton Pile Velvet, quality 8897, black, 72% Cotton, 28% Modal).
2. A pouch is made by sewing a rectangle of black velvet (dimensions 23.5 cm×47 cm that is folded to make a square with the velvet on the inside) using an overlock stitch, sewing along two sides leaving one open edge. The pouch is turned inside out so that the velvet is on the outside.
3. A dosing ball is filled using the recommended dosage for each product according to packaging instructions for normal/median soil and normal/median water hardness (125 g). For every experiment, a new and unused dosing ball is filled. The dosing ball is placed inside the black velvet pouch.
4. The pouch is then closed by making a 2 cm wide fold across the open side and is secured with 3 plastic stitches.
5. For the wash test, the black pouch is placed in the back of the washing machine (Miele Novotronic W527) with the opening of the dosing ball up, without any further ballast load. The washing machine is switched on using the wool wash program at 40° C., using city water (2.5 mmol/L). At end of the wash cycle, the pouches are immediately removed from the washing machine. The pouches are opened along the three sides (all stitched and sewed sides), except the folded side. For every test product, a run with a reference product is performed at the same time (for comparison). Every experiment is repeated 2 times to have 3 replicates per test product.
6. The pouches are graded after drying over night (horizontally on a flat surface), by 2 qualified graders, using the following grading instructions and scale (relative scale to reference product results):

TABLE 1

Residue Grading Scale

| SCORE (PSU) | MEANING |
|---|---|
| 0 | There is no difference |
| −1 | I think this one has more residues (unsure) |
| −2 | This one has somewhat more residues (sure) |
| −3 | This one has a lot more residues |

TABLE 1-continued

| Residue Grading Scale | |
|---|---|
| SCORE (PSU) | MEANING |
| −4 | This one has hugely more residues (a "day and night" difference) |

To indicate less residues (instead of more residues), the signs of the scale above are inverted to positive numbers.

Each item is assessed by the two graders, and the grades are averaged; if the grades given by the two judges differ by more than 1 PSU (except −1 and +1), the grading is repeated. Three replicates are assessed and their results averaged to obtain the final grade.

The residues test described above was carried out using the standard composition described below in Table 2 as a reference composition against the same composition containing one of the different copolymers listed in Table 3.

TABLE 2

| Standard Composition | |
|---|---|
| Ingredients (% by weight) | |
| Copolymer (see Table 3) | 0.19 |
| Alkylbenzene sulfonic acid | 1.2 |
| C14-15 alcohol 8-ethoxylate | 4.0 |
| C12-14 alcohol 3-ethoxylate sulphate, Na salt | 6.8 |
| Citric acid | 2.4 |
| C12-18 fatty acid | 4.5 |
| Detergent enzymes | 0.2 |
| Trans-sulphated ethoxylated hexamethylene diamine quat | 0.7 |
| Pentamethylene triamine pentaphosphonic acid | 0.1 |
| Hydrogenated castor oil | 0.3 |
| Ethanol | 1.0 |
| Boric acid | 1.2 |
| Sodium hydroxide | 3.0 |
| Perfume | 0.6 |
| Water | 72 |
| Dyes, miscellaneous minors | balance |

The copolymers used and the results obtained are summarized in Table 3

TABLE 3

| Copolymers and Test Results | | | | | | | |
|---|---|---|---|---|---|---|---|
| | | Mole % | | | | Overall Mole Ratio | Residue |
| | Material | Acr. Amide | Acr. Acid | MetAcr. Acid | Maptac | An/ (An + Cat) | Results PSU |
| R | Table 2 formulation | None | None | None | None | NA | 0.0 |
| 1 | PamMAPTAC | 88 | 0 | 0 | 12 | 0.00 | −4.0 |
| 2 | Merquat 5300 | 90 | 5 | 0 | 5 | 0.50 | 0.0 |
| 3 | 45D (77/3/20) | 88.7 | 3.4 | 0 | 7.9 | 0.30 | −1.3 |
| 4 | 45C (79/1/20) | 91 | 1.1 | 0 | 7.5 | 0.13 | −2.3 |
| 5 | 50D (35/60/5) | 36 | 62 | 0 | 1.7 | 0.97 | 0.5 |
| 6 | Tetrapolymer 1 | 93.5 | 1.5 | 0 | 5 | 0.23 | −2.1 |
| 7 | Tetrapolymer 2 | 92 | 1.6 | 1.4 | 5 | 0.38 | 0.0 |

The overall mole ratio is defined as: (% Acrylic acid+% methacrylic acid)/(% Acrylic acid+% methacrylic acid+% PamMAPTAC)

Based on consumer input, a residue grade difference of 2 PSU from the reference composition (i.e., a PSU of −2 or less) in this test will deliver consumer noticeable, unsatisfactory, residues levels. Therefore, the polymers which provide acceptable residues levels when included in the standard composition are the Table 2 polymers 2, 3, 5, and 7.

Example II

Softness Testing

The relative softness of fabrics washed in laundry products containing polymers is assessed in a full scale washing machine test using Miele Novotronic W527.

Softness Protocol

Fabric softness is a relative characteristic that in this protocol is evaluated by trained human softness graders that tactically examine a range of white fabric swatches washed in commercially available washing machines with standard dosages of laundry detergent. Identical sets of fabric swatches are separately washed in a reference detergent product and in a test product. The softness results are a comparison of the resulting fabric swatches from each test product wash with the fabrics from the reference detergent product wash using the PSU score described below. All data are generated by using commercially available washing machines manufactured by Miele and sold as the Novatronic W527 model and commercially available laundry dryers manufactured by Miele and sold as the Novotronic T490 model.

Fabric Swatches

Multiple types of fabrics cut into swatches and used to assess the softness. The fabrics used are:

1) White terries with a swatch size of 30 cm×30 cm and a weight of 450 g/m2, supplied by Maes Textiles—Brabantstraat 117, 8790 Waregem, Belgium
2) White knitted 100% cotton with a swatch size of 50 cm×40 cm and a weight of 165-175 g/m2, having a rib of 1/1, supplied by Abanderado Industriepark West 61, 9100 Sint Niklaas, Belgium, and
3) White polycotton (50% polyester blended with 50% cotton) with a swatch size of 100 cm×120 cm and a weight of 130 g/m2, supplied by Dewerchin Vruchtendreef 19, 8520 Kuurne), Belgium De-Sizing All fabric swatches used in the testing protocol, including reference fabric swatches are washed (before beginning testing) three times each with commercially available Aria Liquid (at the recommended dosage for medium soil, medium water hardness of 75 ml, dosed via a dosing ball) at 60° C.

using the short ("wit/bont") standard program with city water (2.5 mmol/l) in order to remove any sizing applied by the manufacturers.

In addition to the fabric swatches, in each washing cycle an extra ballast load is added to get to a total weight of approximately 3 kg of fabrics in the washing cycle (see Table 4, below). The ballast load consists of two large terry towels (80 cm×50 cm, supplied by Maes Textiles) and six pieces of knitted cotton (50 cm×50 cm, supplied by Abanderado). After completion of the three washing cycles, all fabrics are then tumble dried in a commercially available dryer. Upon drying, the fabrics are then ready to use in softness testing.

Test Load

For the reference product and for each of the test compositions, a test load of fabrics as shown in Table 4 is utilized.

TABLE 4

Test Load

| Fabric type | Number of swatches used per load | Total weight of swatches/ballast | Drying process used |
|---|---|---|---|
| Swatches: | | | |
| Terry swatches | 16 | Approx. 660 g | 8 line dry<br>8 tumble dry |
| Knitted cotton | 8 | Approx. 280 g | 8 line dry |
| Polycotton | 8 | Approx. 1260 g | 8 tumble dry |
| Ballast load (not examined): | | | |
| Terry towels | 2 | Approx. 340 g | irrelevant |
| Knitted cotton | 6 | Approx. 450 g | irrelevant |
| | | Total load weight: Approx. 3 kg | |

Testing of Fabric Swatches

A test load of fabrics is then washed three times each in succession (cycles 1, 2, and 3) with 75 ml (recommended dosage for medium water hardness, medium soil) of the laundry product to be analyzed, dispensing with a dosing ball. Reference laundry product is washed under the same conditions as test products.

The washing machines are fed with city water (2.5 mmol/L) at 40° C. and are set to the short ("wit/bont") standard program with spinning at 1200 rpm. The washing machines are not rotated to avoid contamination between the products. All three cycles for each laundry product test load must be completed on the same day with tumble drying of all fabrics in between cycles 1 and 2, and in between cycles 2 and 3, using the setting "Kastdroog" on the dryer.

After cycle 3, the fabrics that need to be line dried (as shown in Table 4) are taken out and line dried overnight in a controlled temperature and humidity room set at 21° C., 50% relative humidity. The other fabrics are dried in a tumble dryer, using the "Extra dry" setting.

The day after drying, the fabric swatches are graded for softness by two different trained softness graders, utilizing a PSU scale. The PSU scale as referenced herein is a paired comparison between a fabric swatch treated with test product and the same type of fabric swatch treated with the reference product, using a grading scale going from −4 to 4. This paired comparison PSU grading scale is shown below in Table 5.

TABLE 5

PSU Grading Scale

| SCORE | MEANING |
|---|---|
| 0 | There is no difference |
| 1 | I think this one is softer (unsure) |
| 2 | I know this one is softer (sure) |
| 3 | This one is a lot more softer |
| 4 | This one is a whole lot softer |

A positive grading scale number indicates that the fabric swatch treated with the test product is softer than the one of the reference product, a negative grading scale number indicates that the reference swatch is softer. If for a particular set of swatches, the grades given by the two softness graders differ by more than 1 PSU (except −1 and +1), regrading occurs.

For each test product, each of the swatches from the load (except the ballast load) is compared with one swatch of the same fabric type washed with the reference product. As such, 32 PSU gradings are completed per grader for each test product (8 gradings for terry swatches line dry, 8 gradings for terry swatches tumble dry, 8 gradings for knitted cotton line dry and 8 numbers for polycotton tumble dry).

At the end, an average softness score is calculated by averaging all 32 gradings from both graders.

Tested Formulations

The softness test described above was carried out using a standard commercially available fabric softening laundry detergent composition shown in Table 6 as a reference product, and comparing it to test compositions according to the formulation set forth in Table 2 containing in turn one of each of the different copolymers listed in Table 3.

TABLE 6

Reference Formulation for Softness Data

| Active Material<br>Composition pH: 7.5-8.5 | Weight % |
|---|---|
| C12-C14 alkyl polyethoxylate (7) | 1.2 |
| Alkylbenzene sulfonic acid | 9.0 |
| Citric Acid | 1.5 |
| C12-18 fatty acid | 4.38 |
| Rapeseed fatty acid | 2.46 |
| Enzymes | 0.4 |
| Boric Acid | 0.79 |
| Diethylene triamine penta methylene phosphonic acid | 0.4 |
| Brightener | 0.09 |
| Hydrogenated Castor Oil structurant | 0.2 |
| Ethanol | 2.38 |
| 1,2 propanediol | 3.68 |
| Sodium hydroxide | 3.34 |
| Sodium cumene sulphonate | 0.8 |
| Polyethyleneimine | 0.06 |
| Silicone suds suppressor | 0.15 |
| Dye | 0.003 |
| Perfume | 0.62 |
| Bentonite softnening clay | 3.36 |
| Water | Up to 100 |

The copolymers used in the test composition and the softness results obtained are summarized in Table 7.

TABLE 7

| | Material | Mole % Acryl-amide | Acrylic Acid | Methacrylic Acid | Maptac | Relative Softness PSU | Overall Mole Ratio |
|---|---|---|---|---|---|---|---|
| R | Table 1 formulation | None | None | None | None | 0 | NA |
| 1 | PamMAPTAC | 88 | 0 | 0 | 12 | +1.0 | 0.00 |
| 2 | Merquat 5300 | 90 | 5 | 0 | 5 | +0.5 | 0.50 |
| 3 | 45D (77/3/20) | 8.7 | 3.4 | 0 | 7.9 | +1.2 | 0.30 |
| 4 | 45C (79/1/20) | 91 | 1.1 | 0 | 7.5 | +0.9 | 0.13 |
| 5 | 50D (35/60/5) | 36 | 62 | 0 | 1.7 | −1.5 | 0.97 |
| 6 | Tetrapolymer 1 | 93.5 | 1.5 | 0 | 5 | 0.8 | 0.23 |
| 7 | Tetrapolymer 2 | 92 | 1.6 | 1.4 | 5 | 0.9 | 0.38 |

As may be seen by comparing the data outlined in Tables 3 and 7, incorporation of polymers 2, 3 or 7 into the test composition of Table 2 provides both good softness benefits and an acceptable amount of residues on fabrics. The other polymers, when incorporated into the test composition of Table 2 are included as comparative examples.

Example III

Detergent Compositions

Additional detergent composition examples according to the present invention are shown as compositions 3A and 3B, below. It is predicted that these formulations will provide good cleaning, softness and acceptably low visible residues on fabrics when used in traditional consumer washing machines.

| Ingredients (% by weight) | 3A | 3B |
|---|---|---|
| Alkylbenzene sulfonic acid | — | 3.0 |
| C14-15 alcohol 8-ethoxylate | — | 2.5 |
| C12-14 alcohol 3-ethoxylate sulphate, Na salt | 22 | 12 |
| N-C10-12 alkyl, N-2-hydroxyethyl, N,N-dimethyl ammonium chloride | 3.0 | 1.5 |
| Citric acid | 3.5 | 1.0 |

-continued

| Ingredients (% by weight) | 3A | 3B |
|---|---|---|
| C12-18 fatty acid | 2.0 | 7.0 |
| Copolymers 2, 3 and/or 7 from Table 7 above | 0.25 | 0.28 |
| Silicone polyether | 2.0 | 2.0 |
| Detergent enzymes | 0.4 | 1.1 |
| Ethoxylated polyimine | 1.3 | 2.0 |
| Pentamethylene triamine pentaphosphonic acid | — | 0.3 |
| Hydrogenated castor oil | — | 0.2 |
| 1,2 propandiol | 5.5 | 0.2 |
| Cumene sulfonic acid, Na salt | 1.5 | — |
| Ethanol | 3.0 | 2.2 |
| Monoethanolamine (MEA) | 2.7 | 10 |
| Boric acid | 0.9 | 1.5 |
| Sodium hydroxide | 3.0 | 3.0 |
| Perfume | 0.6 | 0.7 |
| Water | 47 | 59 |
| Dyes, miscellaneous minors | balance | balance |

Example IV

Additional laundry detergent composition examples according to the present invention are shown as compositions 4A to 4E, below. It is predicted that these formulations will provide good cleaning, softness and acceptably low visible residues on fabrics when used in traditional consumer washing machines.

| Active Material in weight % | Composition pH: 7.5-8.5 4A | 4B | 4C | 4D | 4E |
|---|---|---|---|---|---|
| C14-C15 alkyl poly ethoxylate (8) | 4.4 | 6.25 | 4.0 | 4.0 | 6.25 |
| C12-C14 alkyl poly ethoxylate (3) sulfate Na salt | 7.46 | 10.6 | 6.78 | 6.78 | 10.6 |
| Alkylbenzene sulfonic acid | 1.19 | 0.79 | 1.19 | 1.19 | 0.79 |
| Citric Acid | 2.64 | 3.75 | 2.4 | 2.4 | 3.75 |
| C12-18 fatty acid | 4.93 | 7.02 | 4.48 | 4.48 | 7.02 |
| Enzymes | 0.2 | 0.32 | 0.4 | 0.4 | 0.61 |
| Boric Acid | 1.35 | 1.93 | 1.23 | 1.23 | 1.93 |
| Trans-sulphated ethoxylated hexamethylene diamine quat | 0.78 | 1.11 | 0.71 | 0.71 | 1.11 |
| Diethylene triamine penta methylene phosphonic acid | 0.12 | 0.17 | 0.11 | 0.11 | 0.17 |
| N-C10 alkyl, N-2-hydroxyethyl,N,N-dimethyl ammonium chloride | — | — | 1.0 | — | — |
| Hydrogenated Castor Oil structurant | 0.300 | 0.2 | 0.3 | 0.3 | 0.2 |
| Ethanol | 1.55 | 2.2 | 1.41 | 1.41 | 2.2 |
| 1,2 propanediol | 0.07 | 0.16 | 0.15 | 0.15 | 0.16 |
| Sodium hydroxide | 3.41 | 4.8 | 3.1 | 3.1 | 4.8 |
| Silicone PDMS emulsion | 0.0030 | 0.003 | 0.003 | 0.003 | 0.003 |
| Dye | 0.00084 | 0.00084 | 0.00084 | 0.00084 | 0.00084 |

-continued

| Active Material in weight % | Composition pH: 7.5-8.5 | | | | |
|---|---|---|---|---|---|
| | 4A | 4B | 4C | 4D | 4E |
| Mica/$TiO_2$ (ex BASF) | 0.05 | | — | 0.05 | — |
| Perfume | 0.65 | 0.65 | 0.65 | 0.65 | 1.0 |
| Merquat 5300* | 0.19 | 0.3 | 0.19 | 0.19 | 0.3 |
| Perfume microcapsules** | — | — | 0.325 | 0.325 | 0.52 |
| Water | Up to 100 | Up to 100 | Up to 100 | Up to 100 | Up to 100 |

**Level expressed as perfume oil delivered via capsules

*Merquat 5300 is terpolymer with mole ratio: 90% PAM/5% AA/5% MAPTAC produced by Nalco.

Example V

Additional laundry detergent composition examples according to the present invention are shown as compositions 5A to 5E, below. It is predicted that these formulations will provide good cleaning, softness and acceptably low visible residues on fabrics when used in traditional consumer washing machines.

| Active Material in weight % | Composition pH: 7.5-8.5 | | | | |
|---|---|---|---|---|---|
| | 5A | 5B | 5C | 5D | 5E |
| C14-C15 alkyl poly ethoxylate (8) | — | 15.57 | — | 15.57 | 15.57 |
| C12-C14 alkyl poly ethoxylate (7) | 15.57 | — | 15.57 | — | — |
| Alkylbenzene sulfonic acid | 19.43 | 19.43 | 19.43 | 19.43 | 19.43 |
| Citric Acid | 0.5 | 0.5 | 0.5 | 0.5 | 0.5 |
| C12-18 fatty acid | 15.54 | 15.54 | 15.54 | 15.54 | 15.54 |
| Enzymes | 2.1 | 2.1 | 2.1 | 2.1 | 2.1 |
| Boric Acid | — | 1.0 | 1.0 | 1.0 | 1.0 |
| Trans-sulphated ethoxylated hexamethylene diamine quat | 2.75 | 2.75 | 2.75 | 2.75 | 2.75 |
| PEI 600 EO20 | 1.0 | 1.0 | 1.0 | 1.0 | 1.0 |
| HEDP | 1.0 | 1.0 | 1.0 | 1.0 | 1.0 |
| FWA - Brightener | 0.28 | — | — | — | — |
| Hydrogenated Castor Oil Structurant | 0.2 | 0.2 | 0.2 | 0.2 | 0.2 |
| Glycerol | — | — | — | — | 8 |
| 1,2 propanediol | 8.0 | 8.0 | 8.0 | 8.0 | 9.0 |
| Sodium hydroxide | 0.1 | 0.1 | 0.1 | 0.1 | 0.1 |
| Silicone PDMS emulsion | — | — | — | 0.003 | 0.003 |
| Mono Ethanol Amine (MEA) | 8.84 | 8.84 | 8.84 | 8.84 | 8.84 |
| Mica/$TiO_2$ pearl (ex BASF) | — | 0.1 | 0.05 | — | — |
| Perfume | 1.40 | 1.40 | 1.40 | 1.40 | 1.40 |
| Merquat 5300 | 0.60 | 0.5 | 0.35 | 0.80 | 0.80 |
| Perfume micro capsules | — | — | 0.86 | 0.86 | 0.86 |
| Water (with dyes and other minors) | Up to 100 | Up to 100 | Up to 100 | Up to 100 | Up to 100 |

Example VI

Additional laundry detergent composition examples according to the present invention are shown as compositions 6A to 6D, below. It is predicted that these formulations will provide good cleaning, softness and acceptably low visible residues on fabrics when used in traditional consumer washing machines.

| Active Material | Weight % | | | |
|---|---|---|---|---|
| | 6A | 6B | 6C | 6D |
| C14-C15 alkyl poly ethoxylate (8) | 3.7 | 3.7 | 3.7 | 3.7 |
| C12-C14 alkyl poly ethoxylate (3) sulfate Na salt | 15.0 | 15.0 | 15.0 | 15.0 |
| Alkylbenzene sulfonic acid | 16.3 | 16.3 | 16.3 | 16.3 |
| Citric Acid | 4.1 | 4.1 | 4.1 | 4.1 |
| C12-18 fatty acid | 7.2 | 7.2 | 7.2 | 7.2 |
| Enzymes as raw material solution | 2.4 | 2.4 | 2.4 | 2.4 |
| Boric Acid | 0.5 | 0.5 | 0.5 | 0.5 |
| PEI 600 EO20 | 3 | 3 | 3 | 3 |
| HEDP | 1.6 | 1.6 | 1.6 | 1.6 |
| FWA - Brightener | 0.28 | — | — | — |
| CaCl2 | 0.03 | 0.03 | 0.03 | 0.03 |
| 1,2 propanediol | 4.0 | 4.0 | 4.0 | 4.0 |
| Sodium hydroxide | to pH 8.0 | to pH 8.0 | to pH 8.0 | to pH 8.0 |
| Mono Ethanol Amine (MEA) | 10.31 | 10.31 | 10.31 | 10.31 |
| Dye | 0.001 | 0.001 | 0.001 | 0.001 |
| Mica/$TiO_2$ pearl (ex BASF) | — | 0.05 | — | 0.05 |
| Perfume | 1.5 | 1.5 | 1.5 | 1.5 |
| Merquat 5300 | 0.6 | 0.5 | 0.35 | 0.8 |
| Perfume microcapsules | — | — | 0.86 | 0.86 |
| Water | Up to 100 | Up to 100 | Up to 100 | Up to 100 |

Example VII

Additional laundry detergent composition examples according to the present invention are shown as compositions 7A to 7F, below. It is predicted that these formulations will provide good cleaning, softness and acceptably low visible residues on fabrics when used in traditional consumer washing machines.

| Ingredient (assuming 100% activity) | 7A | 7B | 7C | 7D | 7E | 7F |
|---|---|---|---|---|---|---|
| | | | Weight % | | | |
| AExS | 21.0 | 12.6 | 21.0 | 12.6 | 21.0 | 5.7 |
| LAS | — | 1.7 | — | 1.7 | — | 4.8 |
| Branched Alkyl sulfate | — | 4.1 | — | 4.1 | — | 1.3 |
| NI 23-9 | 0.4 | 0.5 | 0.4 | 0.5 | 0.4 | 0.2 |
| C12 trimethylammonium chloride | 3.0 | — | 3.0 | — | 3.0 | — |
| Citric Acid | 2.5 | 2.4 | 2.5 | 2.4 | 2.5 | — |
| $C_{12-18}$ Fatty Acids | 3.4 | 1.3 | 3.4 | 1.3 | 3.4 | 0.3 |
| Protease B | 0.4 | 0.4 | 0.4 | 0.4 | 0.4 | 0.1 |
| Carezyme | 0.1 | 0.1 | 0.1 | 0.1 | 0.1 | — |
| Tinopal AMS-X | 0.1 | 0.1 | 0.1 | — | 0.1 | 0.3 |
| TinopalCBS-X | — | — | — | | 0.1 | — |
| ethoxylated ($EO_{15}$) tetraethylene pentaimine | 0.3 | 0.4 | 0.3 | 0.4 | 0.3 | 0.4 |
| PEI 600 $EO_{20}$ | 0.6 | 0.8 | 0.6 | 0.8 | 0.6 | 0.3 |
| Zwitterionic ethoxylated quaternized sulfated hexamethylene diamine | 0.8 | — | 0.8 | — | 0.8 | — |
| PP-5495[1] | 3.4 | 3.0 | 3.4 | 3.0 | 3.4 | 2.7 |
| KF-889[2] | — | — | — | — | 3.4 | — |
| Merquat 5300 | 0.2 | 0.2 | 0.2 | 0.2 | — | 0.3 |
| Diethylene triamine penta acetate, MW = 393 | 0.2 | 0.3 | 0.2 | 0.2 | 0.2 | — |
| Mica/TiO2 pearl (ex BASF) | 0.2 | 0.1 | — | — | — | 0.1 |
| Ethyleneglycol distearate (EGDS) pearl | — | — | 1.0 | 1.0 | | — |
| Hydrogenated castor oil | 0.1 | 0.1 | — | — | — | 0.1 |
| Sodium hydroxide | To pH 8.0 | To pH 8.0 | To pH 8.0 | To pH 8.0 | To pH 8.0 | To pH 8.0 |
| water, perfumes, dyes, and other optional agents/components | to 100% balance | to 100% balance | to 100% balance | To 100% balance | to 100% balance | to 100% balance |

[1]supplied by Dow Corning Corporation, Midland, MI
[2]supplied by Shin-Etsu Silicones, Akron, OH

Example VIII

Additional laundry detergent composition examples according to the present invention are shown as compositions 8A to 8C, below. It is predicted that these formulations will provide good cleaning, softness and acceptably low visible residues on fabrics when used in traditional consumer washing machines.

| Ingredient (assuming 100% activity) | 8A weight % | 8B weight % | 8C weight % |
|---|---|---|---|
| AExS | 21.0 | 12.6 | 21.0 |
| LAS | — | 1.7 | — |
| Branched Alkyl sulfate | — | 4.1 | — |
| NI 23-9 | 0.4 | 0.5 | 0.4 |
| C12 trimethylammonium chloride | 3.0 | — | 3.0 |
| Citric Acid | 2.5 | 2.4 | 2.5 |
| $C_{12-18}$ Fatty Acids | 3.4 | 1.3 | 3.4 |
| Protease B | 0.4 | 0.4 | 0.4 |
| Carezyme | 0.1 | 0.1 | 0.1 |
| Tinopal AMS-X | 0.1 | 0.1 | 0.1 |
| TinopalCBS-X | — | — | — |
| ethoxylated ($EO_{15}$) tetraethylene pentaimine | 0.3 | 0.4 | 0.3 |
| PEI 600 $EO_{20}$ | 0.6 | 0.8 | 0.6 |
| Zwitterionic ethoxylated quaternized sulfated hexamethylene diamine | 0.8 | — | 0.8 |
| PP-5495[1] | 3.4 | 3.0 | 3.4 |
| Merquat 5300 | 0.2 | 0.2 | 0.2 |
| Diethylene triamine penta acetate, MW = 393 | 0.2 | 0.3 | 0.2 |

-continued

| Ingredient (assuming 100% activity) | 8A weight % | 8B weight % | 8C weight % |
|---|---|---|---|
| Mica/TiO2 pearl (ex BASF) | 0.2 | — | 0.1 |
| Ethyleneglycol distearate (EGDS pearl) | | 1.0 | — |
| Hydrogenated castor oil | 0.1 | — | 0.1 |
| Sodium Hydroxide | To pH 8.0 | To pH 8.0 | To pH 8.0 |
| water, perfumes, dyes, and other optional agents/components | to 100% balance | to 100% balance | to 100% balance |

[1]supplied by Dow Corning Corporation, Midland, MI

Example IX

Water Soluble Unit Dose Detergent

An example of a laundry detergent composition useful for inclusion in a water soluble (unit dose) detergent package is found below. To form the water soluble package, approximately 45 ml of the composition is enclosed within a Monosol M8630 soluble film by a traditional thermoforming process.

| Active Material | Weight % |
|---|---|
| Glycerol | 7.00 |
| Propylene glycol | 13.30 |
| Monoethanolamine | 6.90 |
| Caustic soda | 1.00 |
| Potassium sulfite | 0.18 |

-continued

| Active Material | Weight % |
|---|---|
| C24EO7 alcohol ethoxylate | 16.90 |
| Optical brightener FWA36 | 0.28 |
| Alkylbenzenesulfonic acid | 22.30 |
| C12-18 fatty acid | 18.20 |
| Protease | 1.10 |
| Perfume | 1.50 |
| Dyes | ppm |
| Minors | <0.1% |
| TiO2 coated mica | 0.10 |
| Silicone softener | 2.00 |
| Hydrogenated castor oil | 0.20 |
| Merquat 5300 | 0.2 |
| Water | 8.83 |
| Total | 100 |

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising from about 5% to about 90%, by weight of the composition, of water and having a pH of from about 6 to about 11, wherein the composition further comprises:

a) from about 0.02% to about 2%, by weight of the composition, of a polymer having a number average molecular weight of from about 700,000 to about 4,000,000 and comprising monomeric units, wherein the monomeric units are derived from monomers, said monomers comprising:

i) at least 50%, by mole, of nonionic monomers selected from acrylamide, N,N-dialkyl acrylamide, methacrylamide, N,N-dialkylmethacrylamide, hydroxyalkyl acrylate and vinyl pyrrolidone, vinyl acetate, vinyl alcohol, and mixtures thereof;

ii) from about 3% to about 30%, by mole, of cationic monomers selected from methacrylamidoalkyl trialkylammonium chloride, acrylamidoalkylltrialkylammonium chloride, and mixtures thereof;

iii) from about 1% to about 20%, by mole, of anionic monomers selected from acrylic acid, methacrylic acid, maleic acid, vinyl sulfonic acid, styrene sulfonic acid, acrylamidopropylmethane sulfonic acid (AMPS), salts thereof, and mixtures thereof;

wherein the overall mole ratio of the monomers, according to the following equation, $$\frac{\text{mole anionic nonomer}}{(\text{mole anionic monomer} + \text{mole cationic monomer})}$$

is from 0.25 to 0.8; and b) from about 5% to about 60%, by weight of the composition, of a surfactant system comprising from about 1% to about 25%, by weight of the surfactant system, of fatty acid.

2. A laundry detergent composition according to claim 1 wherein the nonionic monomers are selected from acrylamide, vinyl pyrrolidone, and mixtures thereof.

3. A laundry detergent composition according to claim 2 wherein the monomeric units are derived from at least 70%, by mole, of acrylamide.

4. A laundry detergent composition according to claim 1 wherein the cationic monomer is selected from [(3-methylacrylamido)alkyl]trialkylammonium chloride.

5. A laundry detergent composition according to claim 4 wherein the cationic monomer is 3-methacrylamidopropyltrimethyl ammonium chloride.

6. A laundry detergent composition according to claim 1 wherein the anionic monomer is selected from acrylic acid, methacrylic acid, and mixtures thereof.

7. A laundry detergent composition according to claim 6 wherein the anionic monomer is acrylic acid.

8. A laundry detergent composition according to claim 1 wherein the mole ratio is from 0.35 to 0.6.

9. A laundry detergent composition according to claim 1 wherein the surfactant system comprises from about 3% to about 15% fatty acid.

10. A laundry detergent composition according to claim 5 wherein the composition further comprises from about 5% to about 25% sodium alkyl ethoxysulfate.

11. A laundry detergent composition according to claim 1 wherein the detergent composition further comprises a fatty acid crystal modifier.

12. A laundry detergent composition according to claim 11 wherein the fatty acid crystal modifier is selected from:

a) at least 5%, by weight of the composition of sodium alkyl ethoxysulfate;

b) from about 0.1% to about 10% of a quaternary ammonium surfactant having the formula

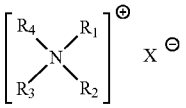

wherein $R_1$ and $R_2$ are individually selected from the group consisting of $C_1$-$C_4$ alkyl, $C_1$-$C_4$ hydroxy alkyl, benzyl, and —$(C_2H_4O)_xH$ where x has a value from about 2 to about 5; X is an anion; and (1) $R_3$ and $R_4$ are each a $C_8$-$C_{14}$ alkyl or (2) $R_3$ is a $C_8$-$C_{22}$ alkyl and $R_4$ is selected from the group consisting of $C_1$-$C_{10}$ alkyl, $C_1$-$C_{10}$ hydroxy alkyl, benzyl, and —$(C_2H_4O)_xH$ where x has a value from about 2 to about 5;

c) from about 0.1% to about 5%, by weight of the composition, of alkoxylated polyethyleneimines having a molecular weight of from about 300 to about 6000 and an average alkoxylation of from about 3 to about 30 moles of alkylene oxide per nitrogen;

d) from about 0.1% to about 5%, by weight of the composition, of ethoxylated tetraethylene-pentaimine having an average ethoxylation of from 15 to 18;

e) from about 1% to about 10% of zwitterionic surfactant;

f) from about 0.05% to about 2% of a chelating agent;

g) from about 0.1% to about 5% of a zwitterionic amine-based polymer;

h) from about 1% to about 10% of a nonionic alkylpolyethoxylate; and i) mixtures thereof.

13. A laundry detergent composition according to claim 1 wherein the composition further comprises a water insoluble fabric care benefit agent selected from dispersible polyolefins, polymer latexes, organosilicones, perfume or other active microcapsules, and mixtures thereof.

14. A laundry detergent composition according to claim 13 wherein the organosilicones are selected from polydimethylsiloxanes, aminosilicones, amidosilicones, silicone polyethers, alkylsilicones, phenyl silicones, quaternary silicones and mixtures thereof.

15. A laundry detergent composition according to claim 1 wherein the composition further comprises from about 0.02% to about 0.5%, by weight of the composition, of a pearlescent agent.

16. A laundry detergent composition according to claim 15 wherein the pearlescent agent is selected from the group consisting of mica, metal oxide coated mica, bismuth oxy chloride coated mica, bismuth oxychloride, glass, metal oxide coated glass, ethylene glycol distearate, fish scales, and mixtures thereof.

17. A laundry detergent composition according to claim 16 wherein the pearlescent agent has an average particle size of from 0.1 μm to 50 μm and has a platelet or spherical geometry.

18. A method for laundering or pre-treating fabrics comprising contacting fabric with the laundry composition according to claim 1.

19. A method for providing softness to fabrics comprising washing fabric with the laundry composition according to claim 1.

* * * * *